United States Patent [19]

Lindley

[11] Patent Number: 4,926,844

[45] Date of Patent: May 22, 1990

[54] SEALING COLLAR FOR A RESUSCITATOR OR RESPIRATOR

[76] Inventor: John E. Lindley, 1410 20th Ave., Meridian, Miss. 39301

[21] Appl. No.: 340,523

[22] Filed: Apr. 19, 1989

[51] Int. Cl.[5] ..... A61H 31/02

[52] U.S. Cl. ..... 128/30; 128/30.2; 128/205.26; 600/21

[58] Field of Search ..... 128/30, 30.2, 721, 205.26, 128/205.28, 205.16, 200.28, 206.21, 367–370, 402, 849, 853, 854; 600/21, 22

[56] References Cited

U.S. PATENT DOCUMENTS

| | | | |
|---|---|---|---|
| 2,494,712 | 1/1950 | Leyenaar | 128/30 |
| 2,702,552 | 2/1955 | Moodie | 128/402 X |
| 2,755,797 | 7/1956 | Loewenstern | 128/30 |
| 2,841,140 | 7/1958 | Lindley et al. | 277/101 |
| 3,575,407 | 4/1971 | Carson | 128/849 X |
| 4,481,938 | 11/1984 | Lindley | 128/30 |
| 4,815,452 | 3/1989 | Hayek | 128/30.2 |

*Primary Examiner*—Richard J. Apley
*Assistant Examiner*—H. Flaxman
*Attorney, Agent, or Firm*—Cushman, Darby & Cushman

[57] ABSTRACT

A collar for a respirator or resuscitator that provides for a relatively air-tight seal on the neck of the patient but is gentle enough to prevent injury to the skin and subcutaneous tissue as well as being constructed so as to minimize pressure on the anterior neck and anterior lateral neck to avoid undue injurious pressure on the jugular vein, carotid arteries, trachea and other delicate structures in this area of the neck. With the two frame parts separated and a patient in place with the neck in the collar opening, the collar is brought up tightly around the back of the neck and the lower collar portion clamped against the head side of the lower frame part by a U-shaped clamp. The upper portion of the collar then is passed between the two separated parts of the collar frame to the body side thereof. The wall or frame parts are then closed. The body side of the upper frame part movably carries an anterior chest seal block which is moved down on the foam-like collar material, pushing the anterior point of pressure of the collar away from the anterior neck and anterior lateral neck of the patient and onto the bony structure of the anterior chest and anterior-lateral chest. That portion of the foam-like sheet extending on the body side then is folded and pushed up against the anterior chest seal block and the upper wall part and is clamped thereagainst.

12 Claims, 4 Drawing Sheets

SEALING COLLAR FOR A RESUSCITATOR OR RESPIRATOR

FIELD OF THE INVENTION

This invention relates to an improved sealing collar, of the type shown in the patent to me and my father U.S. Pat. No. 2,841,140, granted July 1, 1958, for a respirator or more especially for a newborn infant resuscitator of the type having separate head and body compartments, such as is disclosed in my U.S. Pat. No. 4,481,938, granted Nov. 13, 1984, the disclosure of which is incorporated by reference herein.

BACKGROUND OF THE INVENTION

The aforesaid patents disclose a sponge rubber collar having a radial slit therein with overlapping edges for adjustment to necks of different size. Other types of such collars are known, such as the elastic spiral twist collar and the annular sponge rubber collar which is stretched to allow the head of a patient to pass therethrough and then relax to fit snugly around the neck.

All of these known collars have inherent disadvantages, especially for infants. They are essentially flat in use, i.e. the body of the collar remains in a plane at right angles to the neck and closes as tightly on delicate structures of the anterior neck and anterior lateral neck, such as the jugular vein, carotid arteries and trachea, as it does on the posterior neck, i.e. the back of the neck, which has no such superficial delicate structures. Such collars sometimes injure the skin and subcutaneous tissues as well as exert undesirable undue pressure on the jugular vein, carotid arteries, trachea and other delicate structures in the anterior neck and anterior lateral neck. The spiral twist plastic collar has the additional disadvantage of causing a tightening of the collar about the entire neck when pressure is increased in the head or body compartment, producing a highly undesirable tourniquet effect on the neck of the patient.

SUMMARY OF THE INVENTION

An object of this invention is to provide a collar for a respirator or resuscitator that provides for a relatively air-tight seal on the neck of the patient but is gentle enough to prevent injury to the skin and subcutaneous tissue as well as being constructed so as to minimize pressure on the anterior neck and anterior lateral neck to avoid undue injurious pressure on the jugular vein, carotid arteries, trachea and other delicate structures in this area of the neck. An improved collar of this type greatly increases the safety and effectiveness of resuscitators or ventilators or respirators.

The foregoing object and advantages of the invention are accomplished by providing a collar of soft foam, closed cell elastic sheet material that has the usual central neck opening therein and a radial slit having overlappable edges. The lower portion of the collar may be attached to the head side of the lower part of the two-part collar frame or wall which separates the head and body sides of the machine and which parts have opposed recesses to define an opening to loosely receive the neck of a patient. With the two frame parts separated and a patient in place with the neck in the collar opening, the collar is brought up tightly around the back of the neck and the lower portion of the collar clamped against the head side of the lower part by a U-shaped clamp. The upper portion of the collar then is passed between the two separated parts of the collar frame to the body side thereof. The wall or frame parts are then closed and the flaps on the body side of the frame defined by the slit in the foam-like sheet or collar are folded and overlapped over the patients upper torso adjacent the neck.

There is movably carried on the body side of the upper frame part an anterior chest seal block which is moved down on the foam-like material, pushing the anterior point of pressure of the collar away from the anterior neck and anterior lateral neck of the patient and onto the bony structure of the anterior chest and anterior-lateral chest, namely the sternum (breast bone) and both clavicles (collar bone). That portion of the foam-like sheet extending on the body side then is folded and pushed up against the anterior chest seal block and the upper wall part and is clamped thereagainst by the two arms of a scissors clamp. This arrangement produces a relatively air-tight seal around the patient's posterior neck and arterior chest, while avoiding pressure on the arterior neck and anterior lateral neck but maintaining a continuous area of pressure on the patient's skin to provide the necessary seal.

This arrangement of the collar is adjustable for different size necks by varying the size of the anterior chest seal block which allows for greater or lesser downward pressure against the bony structure of the anterior chest while the elasticity of the foam-like sheet provides a closer fit and seal for the posterior neck. A further advantage is that the soft foam-like, closed cell sheet is less abrasive and therefore less likely to cause skin irritation. The hole in the center of the collar may be made in various sizes for necks of different size. Also the radial slit from the hole to the periphery of the collar allows for overlapping of the edges of the slit to give varying adjustment for necks and chests of different size.

While this invention will hereafter be described in detail with reference to a resuscitator, such as that shown in my above-mentioned U.S. Pat. No. 4,481,938, it will be understood that this invention is applicable for use in any resuscitator or respirator wherein the body or head of a patient, or both, is enclosed in a pressure chamber.

DETAILED DESCRIPTION OF THE INVENTION

Figure 2:
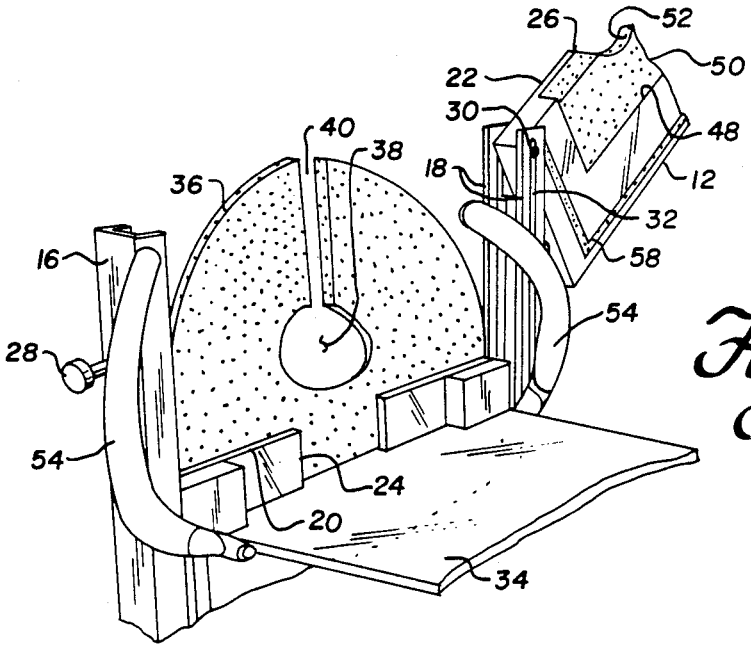
FIG. 2 is a fragmentary view of the body side of the wall shown in FIG. 1 with the upper part of the wall completely separated from the lower part and the collar partly opened to receive a patient.

Referring now to the drawings, there is shown an upright wall 10 preferably of transparent plastic material for dividing the patient compartment of a resuscitator into head and body pressure-tight compartments. The wall 10 is formed with an upper section 12 and a lower section 14, the latter normally being fixed to the bed (not shown) of the machine, while the upper section 12 is slidable vertically in lateral upright channels 16, 18 fixed to the machine bed. These wall sections 12, 14 are formed with meeting edges 20, 22 having opposed recesses 24, 26 therein to define a central opening for loosely receiving the neck of a patient. Spring-pressed lock pins 28 are mounted in the web or base of the channels 16, 18 receivable in corresponding holes the lateral sides of the upper section 12 for retaining the same in closed position wherein the meeting edges 20, 22 of the sections 12, 14 are engaged. Preferably, one of the sides of the upper section 12 is provided with pivot pins 30 slidable in longitudinal slots 32 in the sides of the corresponding channel 18 so that the upper section 12 may be slid upward, disengaged from the other channel 16 and thence pivoted outward or laterally as shown in FIG. 2 (for which purpose the web of the channel 18 is cut away at its upper end) to completely separate the upper section from the lower section 14 so that a patient may be placed properly, without obtructions, in the respirator.

As shown in my aforesaid patent, there is a table 34 in the body compartment of the resuscitator, extending from the lower edge of the recess 24 in the lower wall section 14 and slightly inclined upward from the head toward the feet, for reception of the torso and legs and arms of the patient.

Figure 1:
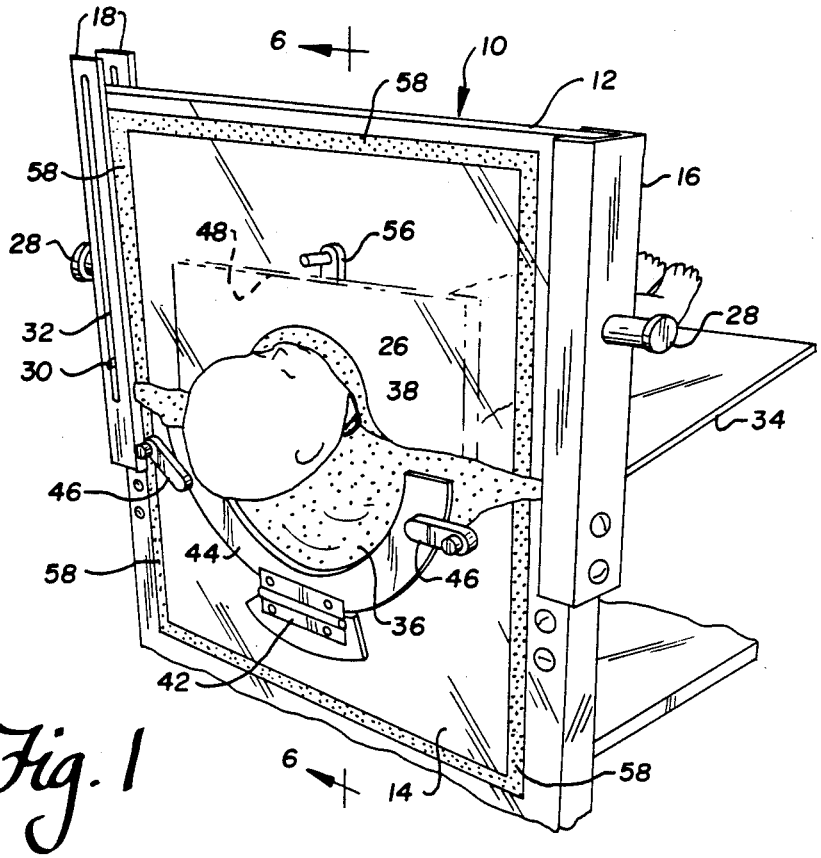
FIG. 1 is a fragmentary perspective view of the head side of the dividing wall of a resuscitator embodying this invention with a patient sealed therein.
Figure 4:
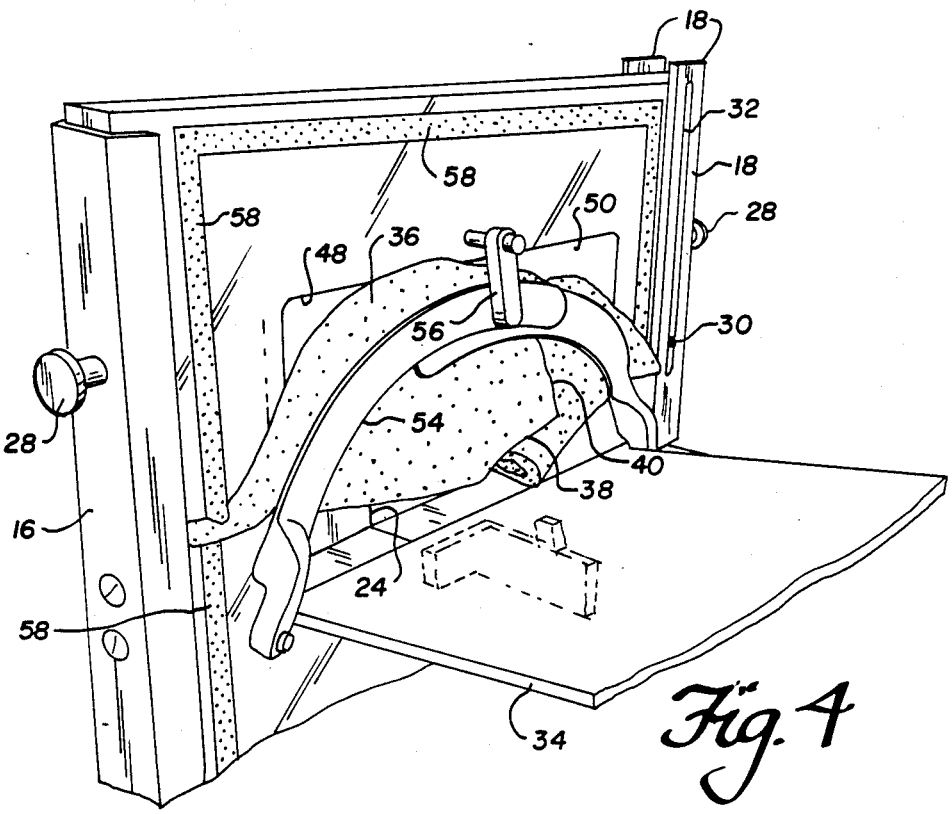
FIG. 4 is a view corresponding to FIG. 3 but with the upper part of the wall closed against the lower part and with the body side of the collar clamped in place.
Figure 6:
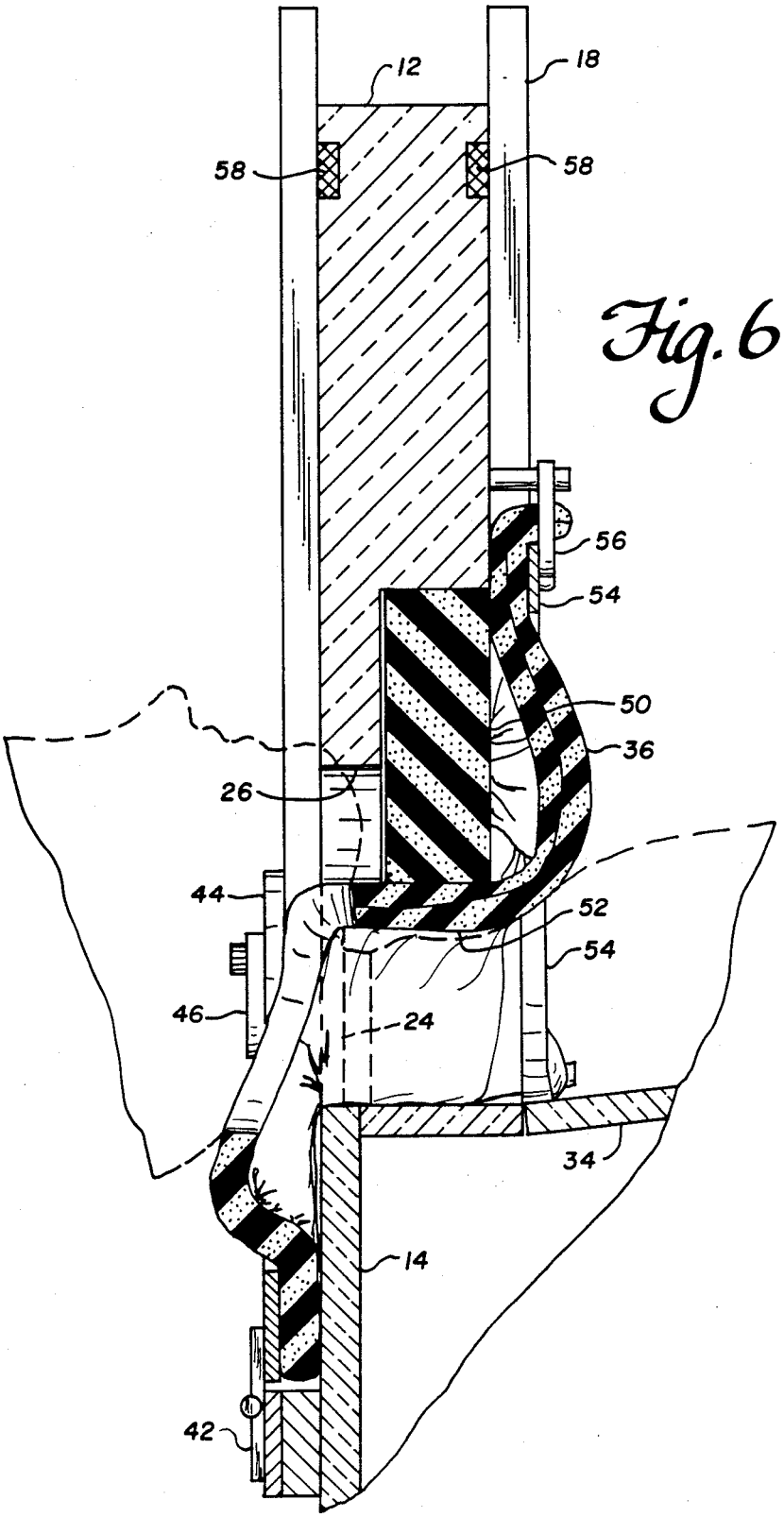
FIG. 6 is a sectional view taken substantially on line 6—6 of FIG. 1.

Secured, preferably detachably, to the head side of the wall section 14 is the lower portion of a sealing collar 36 of soft foam, closed-cell sheet material having a central opening 38 with a slit 40 extending generally radially therefrom to the outer edge of the upper portion of the collar. With the upper wall section 12 raised, the collar extends upward from its lower portion and the flaps or edge portions of the slit 40 are pulled apart for reception of the neck of a patient in the collar opening 38, as shown in FIG. 2. After a patient has been placed on the table 34 in the resuscitator with the neck in the recess 24 and in the collar opening 38, the posterior neck is snugly cradled in the lower portion of the collar opening 38 to seal thereagainst and the head gently supported by a bulge in the collar 36 as shown in FIGS. 1, 4, and 6.

Figure 3:
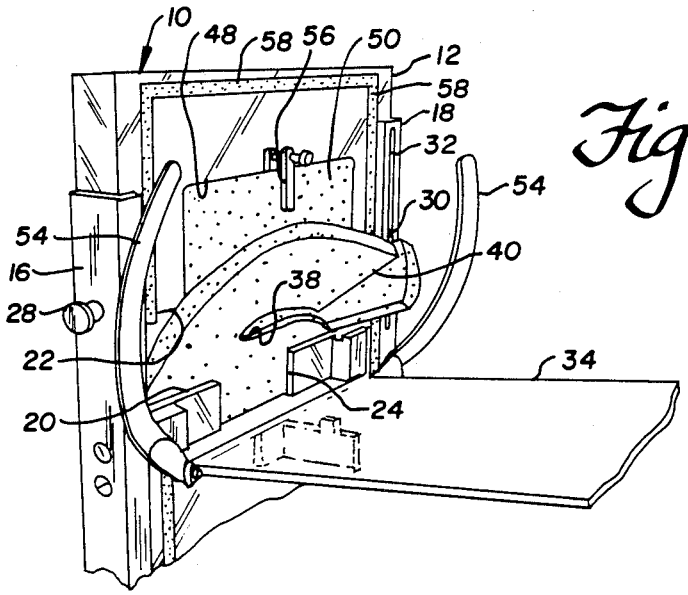
FIG. 3 is a fragmentary perspective view similar to FIG. 2 but with no patient and with the upper wall part partially closed against the lower part.
Figure 5:
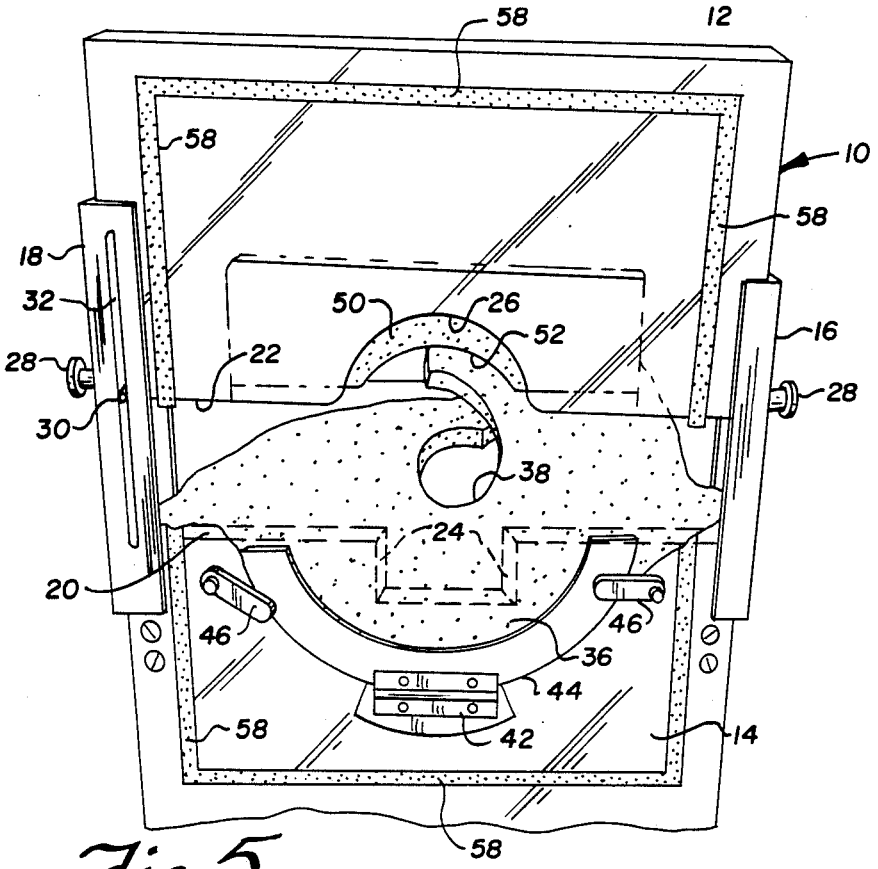
FIG. 5 is a view in elevation of the head side of the wall with the upper wall part partially separated from the lower part and with the head side of the collar clamped against the lower part of the wall.

Carried on a horizontal pivot or hinge 42 on the head compartment side of the lower wall section 14 is the base of a U-shaped clamp 44 which after the patient has been placed in the resuscitator, or later after the upper wall section 12 has been moved down, is moved up so that the clamp arms press the collar 36 against the head side of the lower wall section 14, as shown in FIGS. 1, 5, 6 and 7 to effect a seal therebetween. The clamp 44 is locked in this position by manually-operable latches 46 mounted to the head side of the lower wall section 14. The flaps or edge portions of the slit 40 on the body side of the wall 10 then are folded across the anterior upper torso or anterior chest portion of the patient adjacent the neck and overlapped to form a seal, as shown somewhat in FIGS. 2, 3 and 5. Then the upper wall section 12 is moved down to its closed position wherein the meeting edges 20, 22 of the wall sections 12, 14 are engaged. Preferably the collar is wide enough or has lateral tabs to be interposed completely between the edges 20, 22 to form a seal therebetween, but it will be realized that such a seal may be formed otherwise by appropriate means.

The body side of the upper wall section 12 has a recess 48 therein which opens to the edge of the recess 26 and the meeting edge 22. The recess 48 carries what may be termed an anterior chest seal block 50. Both the block 50 and the recess 48 may be generally rectangular. This block 50 has a recess 52 in its lower edge shallower than the recess 26, adapted to be engaged with the overlapping portions of the collar 36 and to press them against the upper portion of the anterior torso of the patient adjacent the neck to complete the seal between the neck and the collar. The block 50 is removably carried in the recess 48 and is adjustable up and down therein so that it can be moved down to press against the collar 36 as aforesaid. As will be readily understood, means for pressing against the upper portion of the torso can be provided by construction other than the block.

Pivotally or preferably swivelly secured, as by ball and socket joints, to the body side of the lower wall section 14 are the lower ends of the two curved arms 54 of a scissor type clamp. After the anterior chest seal block 50 has been moved down as aforesaid, the portion of the collar 36 on the body side of the wall 10 is moved up over the block 50 and the body side of the upper wall section 14, The arms 54 then are moved up to press the collar against the block 50 and the body side of the upper wall section 14 to seal the collar thereto and to retain the block in place. The upper ends of the arms 54 are overlapped and locked in this sealing and pressing position by a hand operable latch 56 mounted to the upper wall section 14.

As mentioned above, the collar 36 preferably is detachably secured to the head side of the lower wall section 14 so that the collar can be removed for sterilization or for replacement by one with a different size central aperture. Preferably the chest seal block 50 is of elastic rubbery material, e.g. elastic foam, which is firmer than the material of the collar 36, to permit careful adjustment of the pressure of the block on the collar and the underlyng chest structure of the patient to minimize such pressure while maintaining an effective seal.

Figure 7:
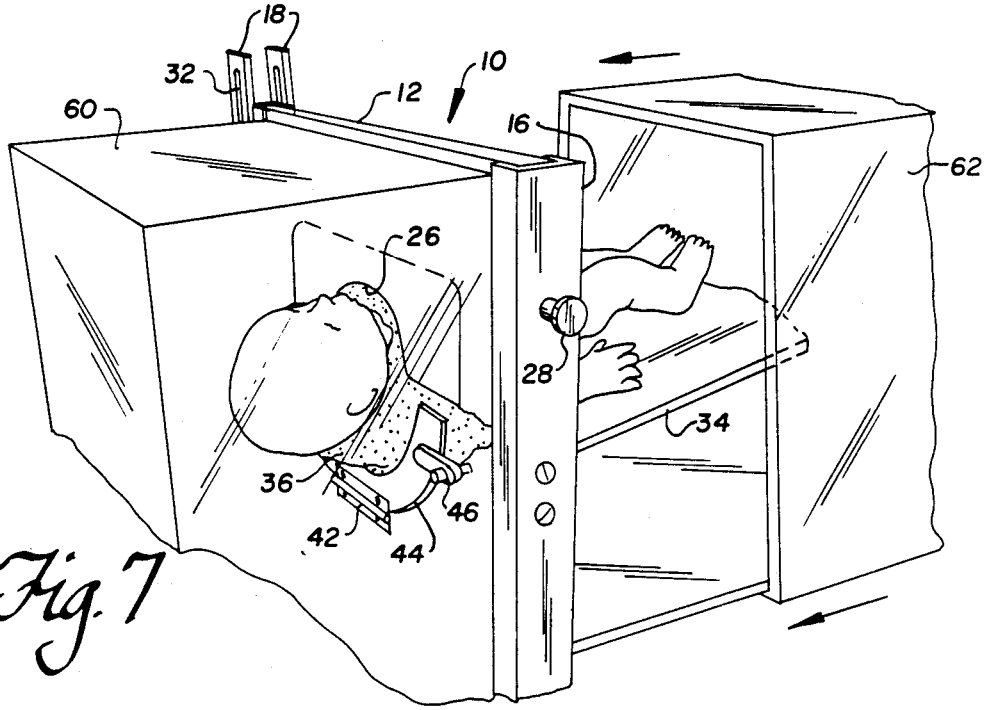
FIG. 7 is a perspective view similar to FIG. 1 showing the housings which together with the wall form the head and body compartments of the resuscitator.

Extending along the opposite sides of the wall 10 adjacent its lateral and upper and lower edges are gaskets 58, continuous when the meeting edges 20, 22 are engaged. Against these gaskets 58 seal the edges of housings 60, 62 which, together with the wall 10, form the head and body compartments. Preferably, the housing 62, which together with the wall 10 forms the body compartment, is movable or slidable along appropriate tracks (not shown) to move horizontally toward and away from the upright wall 10, as shown in FIG. 7. The housing 60, which together with the wall 10 forms the head compartment, preferably is pivotally connected to the bed of the resuscitator so that it can be moved upward and bring its edges into sealing engagement with the gaskets 58 on the head side of the wall 10, as shown in FIG. 7.

It will be seen that the foregoing construction produces a relatively air-tight seal around a patient's posterior neck and anterior chest which avoids undue pressure on the anterior neck and anterior lateral neck but maintains a continuous area of pressure on the patient's skin to provide the necessary seal. It also will be seen that the arrangement of the collar is adjustable for necks of different size by varying the size of the anterior chest seal block 50 which allows for greater or lesser downward pressure against the bony structure of the anterior chest while the elasticity of the collar 36 provides a close fit and seal for the posterior neck. Still further, the soft foam-like closed cell material of the collar 36 is less abrasive and therefore less likely to cause skin irritation. Still further, the hole 38 in the center of the collar 36 may be made in varying sizes adjusted for necks of different size. The overlapping edge portions of the radial slit 40 in the collar also provide for varying adjustment for chests and necks of different size. Still further, it will be seen that this improved collar not only prevents injuries to the skin and subcutaneous tissue but also minimizes pressure on the anterior neck and arterior lateral neck of a patient to avoid pressure on the jugular vein, carotid arterties and other delicate structures in this area, such as the trachea.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

I claim:

1. A wall and collar for a pressure chamber of a resuscitator or respirator, said wall having a generally central opening for loosely enclosing the neck of a patient wherein in use a patient's head will be located on one side of the wall while the rest of a patient's body will be on the other side of the wall, comprising:

upper and lower wall sections together defining said opening;

means mounting said upper section for movement away from said lower section for reception of the neck of a supine patient in said opening, and back toward said lower section to loosely enclose the neck;

collar means of elastic sealing material for cradling and sealing against the for posterior neck, for gently wrapping and sealing against the posterior lateral neck and for pressing and sealing against the upper anterior torso adjacent the neck of a patient without pressing tightly against the jugular vein, carotid arteries trachea and other delicate structures of the anterior neck and anterior lateral neck of a patient, and clamp means for pressing a lower portion of said collar means against the head side of said wall about said opening and an for pressing upper portion of said collar means against the body side of said wall about said opening to form a seal between the head and body sides of said wall.

2. The wall and collar defined in claim 1 wherein the collar means is of soft foam, closed-cell sheet material.

3. The wall and collar defined in claim 1 wherein the collar means has a radial slit extending from the opening therein to the outer edge of said collar means, said slit having edge portions overlappable to form a seal and to adjust said collar to patients of different size.

4. The wall and collar defined in claim 1 including means carried by the upper section for pressing the collar means onto the upper anterior torso adjacent the neck of a patient to seal thereagainst.

5. The wall and collar defined in claim 1 wherein the wall sections have meeting edges on the opposite sides of the wall opening and the collar means is interposable between said edges throughout their length to form a seal therebetween.

6. The wall and collar defined in claim 1 where the clamp means includes U-shaped clamp means movably carried on the head side of said wall for pressing the lower portion of the collar means against said side to form a seal therebetween.

7. The wall and collar defined in claim 1 wherein the clamp means includes clamp means movably carried on the body side of said wall for pressing the upper portion of the collar means against the body side of the upper section to form a seal therebetween.

8. The wall and collar defined in claim 1 including upright channel means slidably carrying lateral edge portions of the upper section for movement thereof toward and away from the lower section.

9. The wall and collar defined in claim 8 wherein one of the lateral edge portions is disengageable from its corresponding channel means by movement away from the lower section and including means connecting the other lateral edge portion to its corresponding channel means for lateral pivotal movement of said upper section on said disengagement to fully separate said upper section from said lower section to enable placement of a patient into the resuscitator without obstructions.

10. The wall defined in claim including movable housings defining, together with said wall, substantially pressure-tight head and body compartments and including gasket means between said wall and opposed edges of said housings to form a seal therebetween.

11. A wall and collar dividing the patient chamber of a resuscitator into head and body compartments comprising:

upper and lower wall sections having meeting edges with opposed recesses to define an opening for loosely receiving the neck of a supine patient;

means mounting said upper section for movement toward and away from said lower section to respectively engage said edges and position said upper section for placement of a patient in the resuscitator with the neck in the recess in the lower section without obstructions;

a substantially flat collar of resilient sealing material having upper and lower portions and slit in said upper portion extending generally radially from a generally central opening to the outer edge of said collar with the edge portions of said slit being overlappable for adjustment of said collar to fit patients of different size, said lower portion being disposed against the head compartment side of said lower section and said collar being wrappable about a patient's posterior neck and thence said upper portion folded across the anterior torso of a patient adjacent the neck with the edge portions of said slit overlapped;

means for pressing said collar lower portion against said head side of said lower section to form a seal therebetween;

block means movably carried by said upper section on the body side thereof, said block means having a recess in the lower edge thereof to press downward against the portion of said collar covering the said anterior torso when said meeting edges are engaged, said upper collar portion being then foldable upward over the body compartment side of said block means and of said upper section; and means for pressing said upper collar portion against said block means and upper section to form a seal therebetween.

12. The wall defined in claim 11 wherein the block means is of rubbery material stiffer than the material of the collar.

* * * * *